United States Patent [19]

Davis

[11] Patent Number: 4,492,335

[45] Date of Patent: Jan. 8, 1985

[54] MAILBOX SIGNALING DEVICE

[76] Inventor: Bobby V. Davis, 2057 Rathburn Rd., Wooster, Wayne County, Ohio 44691

[21] Appl. No.: 549,917

[22] Filed: Nov. 9, 1983

[51] Int. Cl.[3] ..... B65D 91/00

[52] U.S. Cl. ..... 232/35; 232/34

[58] Field of Search ..... 232/34, 35

[56] References Cited

U.S. PATENT DOCUMENTS

| | | | |
|---|---|---|---|
| 2,730,296 | 1/1956 | Haserodt | 232/35 |
| 2,808,982 | 10/1957 | Armstrong | 232/35 |
| 4,363,439 | 12/1982 | Manian | 232/35 |
| 4,382,542 | 5/1983 | Farris | 232/35 |

*Primary Examiner*—Gene Mancene
*Assistant Examiner*—John G. Weiss
*Attorney, Agent, or Firm*—Frease & Bishop

[57] ABSTRACT

A signaling device is shown for signaling the delivery by the mailman of mail into the mailbox. A flat signal member is provided having a large area visible from a considerable distance and from any angle of where the signal member is hanging below the box in signaling position. The signal member is mounted for pivotal movement on the mailbox between signaling and non-signaling positions independently of opening and closing movement of the mailbox door. The mailman, if delivering mail, releases the signal member from a latched position on the door to drop to signaling position before opening the door to deliver mail. If not released, the signal member performs no signaling function and is not affected by opening and closing the door merely for mail pickup. Two forms of the signaling device are shown, one for original box manufacture and the other for attaching the signaling device to an existing mailbox.

3 Claims, 5 Drawing Figures

MAILBOX SIGNALING DEVICE

BACKGROUND OF THE INVENTION

1. Field of the Invention

The invention relates to mailboxes, primarily rural mailboxes, and to a signaling device for usual mailboxes for indicating that mail has been delivered to and placed in the mailbox. More particularly the invention relates to a signaling device which may be visible for inspection from a considerable distance, and which indicates the presence of delivered mail in the mailbox, to avoid unnecessary trips to the mailbox to determine whether mail has been delivered.

Further, the invention relates to a mail delivery-indicating signaling device associated with a mailbox which has its signal, when in signaling position, visible from either side of or from the front or rear of the mailbox.

In addition, the invention relates to a mail delivery-indicating signaling device associated with the mailbox door which device must be actuated by the mailman to indicate mail delivery, before the mailman opens the mailbox door to deposit mail in the mailbox.

Also, the invention relates to a mail delivery-indicating signaling device which may be incorporated in a new mailbox, or may be attached to existing mailboxes.

Finally, the invention relates to a mailbox signaling device associated with the mailbox door which device is not actuated to signaling position if the mailman opens the mailbox door merely or only for the purpose of removing mail from the mailbox that is present in the mailbox to be picked up.

2. Description of the Prior Art

There are a number of examples in the prior art of signaling devices intended to indicate that mail is to be picked up from the box, or that mail has been delivered to the box, or both. However, all prior art of which I am aware involves actuation of the signaling device indicating mail delivery, as a result of opening movement of the mailbox door, such door movement releases the signaling device for movement to signaling position. Thus, an incorrect mail delivery signal is given if the mailbox door has been opened only to pick up mail present in the mailbox for pickup. This problem is inherent in mailboxes provided with signaling devices which are actuated or released or otherwise moved to signaling position as a result of opening movement of the mailbox door.

Examples of such prior mailbox signaling devices occur in U.S. Pat. Nos. 4,363,439, 4,382,542, 2,639,856, 4,182,479 and 2,988,268. Some of these state of the art patent disclosures are impractical because their signal flags or indicators are so small and are located in such position when signaling that they may only be seen when signaling at a close range and from a limited viewing location.

Accordingly, there long has been a need existing in the art for a mailbox mail delivery signaling device which does not give incorrect signals, and is reliable, accurate and readily visible when in a signaling mode, from a viewing station at a considerable distance, and at almost any location around the mailbox, and gives a signal that mail has been deposited by the mailman in the mailbox, in which such signaling device must be actuated by the mailman before opening the mailbox door, and also in which the signaling device may be incorporated in new mailboxes, or added to existing mailboxes in a simple, inexpensive and reliable manner.

SUMMARY OF THE INVENTION

Objectives of the invention include providing a mail delivery signaling device for mailboxes which must be operated by the mailman to indicate that mail is being delivered into the mailbox before the door of the mailbox is opened by the mailman; providing such mailbox signaling device which readily may be incorporated in new mailbox construction or added as an attachment to existing mailboxes; providing such mailbox signaling device which, when actuated, has its signal flag size and location such that it may be viewed from a considerable distance from any viewing location in the vicinity of the mailbox; providing such new mailbox signaling device which does not exhibit an incorrect signal of the delivery of mail when no mail has been delivered and when the mailbox door has been opened only for removing mail located in the mailbox for pickup; and providing such new mailbox mail delivery signaling device which achieves the stated objectives and eliminates difficulties present in prior art mailbox signaling devices in a reliable, effective and efficient manner, and which solves a problem that has long existed in the art, and satisfies such need that has existed.

These and other objectives and advantages may be obtained by the construction which may be stated in general terms as a mail delivery-indicating signaling device for a mailbox of the type having a box provided with an open end, a flanged door for said open end having a pivot mounting at the bottom door edge on the mailbox for movement between open and closed positions with respect to said box open end, and latch means normally holding the door in closed position; in which the latch means includes an L-shaped bracket mounted on the door adjacent the top door edge projecting outward of the door releasably engageable with a bracket mounted on the box; in which said L-shaped bracket has a flat downturned flange spaced outward of and oriented parallel to said door adapted to be engaged by the mailman and pulled outwardly to open the door on said pivot mounting; in which the mailbox is provided with a mail pickup signal device; and in which the mailbox is provided with a mail delivery signaling device actuated or released for movement to signaling position upon movement of the door to open position; wherein the improvement comprises a generally flat mail delivery-indicating signal member pivotally mounted on the mailbox for movement between signaling and nonsignaling positions independently of opening and closing movements of the mailbox door and having a contour similar to that of the mailbox door and also having a height less than that of said door and a width substantially the same as that of said door; a signal control strap pivotally mounted on the flat signal member adjacent the top edge of said signal member for rotational movement above and laterally of the flat signal member and releasably connected with said latch means flat downturned L-shaped bracket flange when said strap extends vertically upward from said flat signal member; and said strap having actuating flange means adapted to be pressed by a mailman to rotate said strap to disconnect said strap from said flat downturned bracket flange to permit said signal member to rotate on its pivotal mounting independently of mailbox door movement to a mail delivery-indicating position below said door, before the door is opened by the mailman pulling said flat downturned bracket flange to deliver mail into said box; whereby said door may be opened and closed by the mailman without disconnecting said flat signal member to pick up mail in the box.

BRIEF DESCRIPTION OF THE DRAWING

Preferred embodiments of the invention—illustrative of the best mode in which Applicant has contemplated applying the principles—are set forth in the following description and shown in the drawing and are particularly and distinctly pointed out and set forth in the appended claims.

Similar numerals refer to similar parts throughout the various figures of the drawing.

DESCRIPTION OF THE PREFERRED EMBODIMENTS

Figure 1:
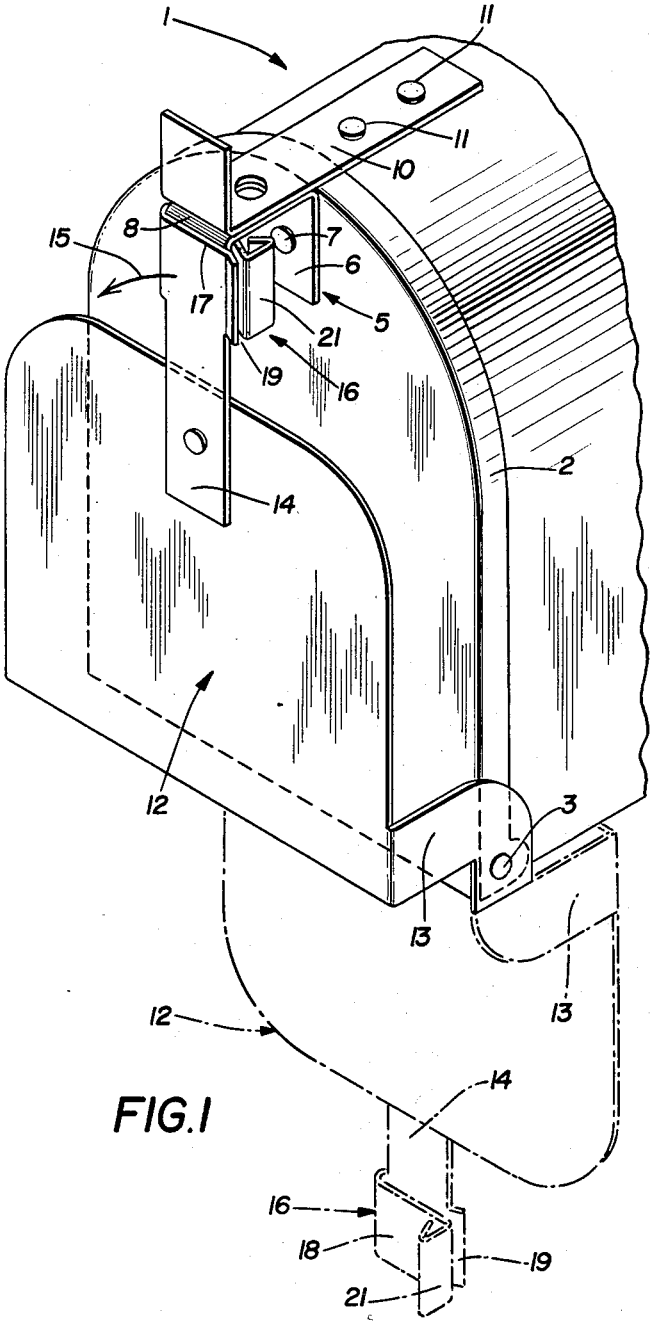
FIG. 1 is a perspective view of a fragmentary end portion of a typical known mailbox and mailbox door equipped with the new mail delivery-indicating signaling device of the invention, the signaling member being shown in full lines in normal nonsignaling position, and in dot-dash lines in signaling position.

An end of a usual, typical and well-known primarily rural mailbox is generally indicated at 1. Mailbox 1 has a flanged door 2 pivotally mounted on the box at 3 in the usual manner. The pivotal mounting 3 is located at the bottom door edge and enables movement of the door 2 between open and closed positions with respect to the box open end 4 (FIG. 5) in the usual and well-known manner.

The known mailbox construction is equipped with door latch means normally holding the door in closed position. The latch means includes a pull bracket generally indicated at 5 mounted on the door by flange 6 and rivet 7. The bracket 5 has an L-shaped portion 8 projecting outwardly of the door 2 adjacent the top door edge and has a flat downturned flange 9 spaced outward of and oriented parallel to the door.

Flange 9 is adapted to be engaged by the mailman and pulled outwardly to open the door 2 on the pivotal mounting 3. The door 2 is latched closed in normal position as shown in FIG. 1 by engagement of the bracket 5 with a top bracket 10 mounted at 11 on the box 1.

Mailboxes 1 are provided in a known manner with a usual movable mail pickup flag, now shown, which forms no part of the present invention.

In accordance with the present invention the mailbox 1 is provided with a generally flat, preferably sheet metal, mail delivery-indicating signal member generally indicated at 12. The signal member 12 preferably has a contour similar to that of the door 2, as shown in FIG. 1, but has a height less than that of the door 2 and a width substantially the same as that of the door 2 for a purpose to be described below.

The signal member 12 is pivotally mounted on the mailbox 1 for movement between signaling and nonsignaling positions independently of opening and closing movement of the mailbox door 2, preferably by providing hinge brackets 13 extending integrally perpendicularly from the signal member 12 at each bottom corner of the member 12, as shown in FIG. 1, and by pivoting said hinge brackets 13 to the pivot member 3 on which the door 2 also is independently pivotally mounted.

A signal control strap 14 is pivotally mounted on the signal member 12 adjacent the top edge of the signal member for rotational movement above and laterally of the signal member 12 as indicated by the arrow 15 in FIG. 1.

Figure 2:
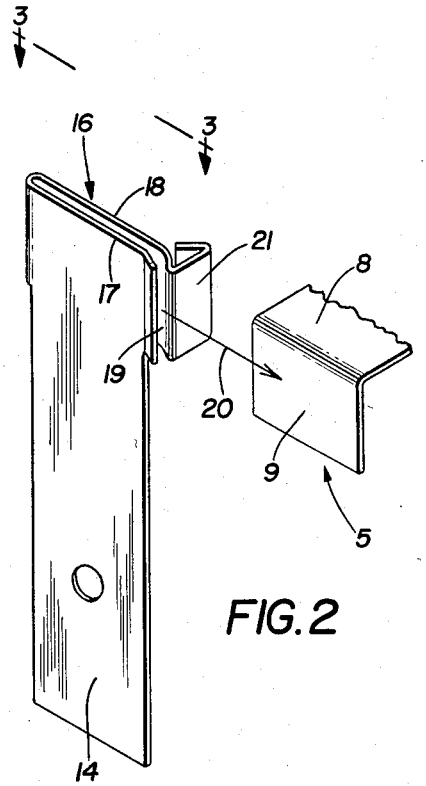
FIG. 2 is a fragmentary exploded perspective view of the signal control strap detached from the signal member to show the manner in which the strap is engaged with the flat downturned flange of the L-shaped bracket portion of the mailbox door latch means.
Figure 3:
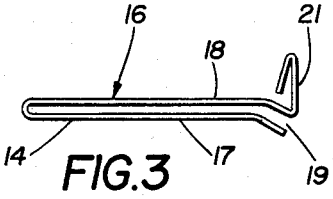
FIG. 3 is a top plan view looking in the direction of the arrows 3—3, FIG. 2, at the top of the signal control strap.

The strap 14 has an integral U-shaped clamp formation generally indicated at 16 at its upper end comprising clamp portions 17 and 18 with a lateral opening 19 between clamp portions 17 and 18 as best shown in FIGS. 2 and 3. The clamp formation 16 is adapted to be releasably connected with the latch member downturned flange 9 when the control strap 14 extends vertically upward from the signal member 12 as shown in FIG. 1.

The clamped connection is established by rotating the strap 14 from a nonvertical position laterally in a clockwise direction, opposite to the indication of the arrow 15, to enter the pull bracket flange 9 through the lateral clamp opening 19 between clamp portions 17 and 18 as indicated by the arrow 20 in FIG. 2.

When the signal control strap 14 and flange 9 are in clamped connection as shown in FIG. 1, the signal member 12 is held in nonsignaling position so that when the door 2 is opened and closed by a mailman merely to pick up mail in the box 1, the signal member 12 is not released to drop to the signaling position shown in dot-dash lines in FIG. 1 but remains connected to the door 2.

The U-shaped clamp formation 16 has a triangularly shaped actuating flange 21 formed at the open end of clamp portion 18. This actuating flange 21 is engaged by a mailman and pushed to rotate the strap 14 in the direction of the arrow 15 to disconnect the clamped connection of the strap 14 from bracket flange 9, when the mailman has mail to be delivered into the box 1. Upon such disconnection of the clamp formation 16 from flange 9, the signal member 12 rotates on the pivot mounting 3 independently of the door 2 and drops to the signaling position indicated in dot-dash lines in FIG. 1 to indicate the delivery of mail.

The mailman then pulls the bracket flange 9 outward to open the mailbox door 2 and deposits mail in the box 1, whereupon the door is closed and held closed by the engaged latch brackets 5 and 10. The signal member 12 remains in the signaling position shown in dot-dash lines in FIG. 1.

The signal member 12, because of its size and shape, when in signaling position is clearly visible from a view station a considerable distance from the mailbox and from any location around the mailbox without its visibility being cut off by the post on which the mailbox 1 may be mounted.

Thus, the new signaling device of the invention may be seen with the signal member 12 in signaling position from a house a great distance away from the mailbox for an accurate and reliable indication that mail has been delivered and deposited in the box.

In this manner the signal member 12 is and must be actuated by the mailman in the process of delivering mail to indicate delivered mail, before the door of the mailbox is opened for such delivery.

To the contrary, if the mailbox door is opened without disconnecting the signal member from the door only for picking up mail, no incorrect signal is given which is given in prior art devices wherein the mail delivery signal is actuated by opening the mailbox door.

The construction shown in FIG. 1 is specially adapted for including the new signaling device in the original manufacture of mailboxes in that the signal member 12 may be assembled on the same pivotal mounting 3 as the door 2 during the manufacture of the mailbox.

Figure 5:
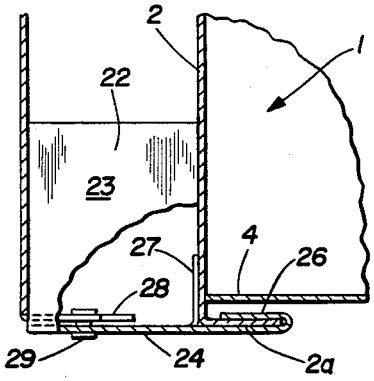
FIG. 5 is a fragmentary sectional view of the construction shown in FIG. 4 taken on the line 5—5, FIG. 4.
Figure 4:
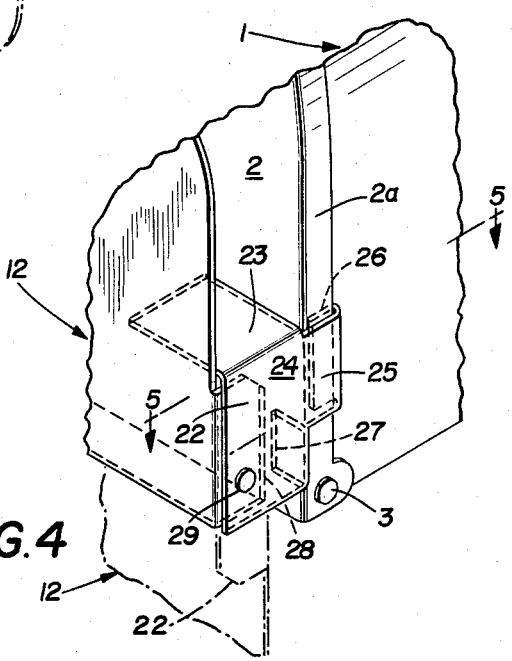
FIG. 4 is a fragmentary perspective view similar to a portion of FIG. 1 showing an alternate manner of pivotally mounting the flat signal member on the mailbox for movement of the signal member with respect to the mailbox, independently of movement of the door on the mailbox, when the signal control strap is disconnected from the L-shaped bracket door pull member, showing the flat signal member in full lines in normal nonsignaling position and in dot-dash lines in signaling position.

The alternate form of the invention illustrated in FIGS. 4 and 5 is identical in all respects to the signal device of FIG. 1 except for the manner of mounting the signal device on the mailbox. The construction of FIGS. 4 and 5 is adapted for being added to existing mailboxes as an accessory. Mailboxes installed and in use may be equipped with the new mail delivery-indicating signaling construction using the components shown in FIGS. 4 and 5.

To accomplish installed box conversion, an L-shaped hinge member 22 is formed for connection with the flange 2*a* of the door 2. Member 22 has an inturned top leg 23 and a downturned hinge leg 24. The upper portion of hinge leg 24 has an extension 25 projecting beyond the inner edge of the top leg. The extension 25 terminates in an infold portion 26 which is crimped around the flange 2*a* of the door 2 (FIG. 4) to mount the member 22 on the door. An inturned tab 27 formed adjacent the lower inner portion of the hinge leg 24 engages the front of the door 2 to hold the L-shaped hinge member 22 securely in place on the door between the tab 27 and infold 26. A similar L-shaped hinge member is located and mounted on the door 2 at the other bottom corner of the door.

The signal member 12 has a hinge bracket 28 at each bottom corner which is pivotally connected at 29 to the downturned hinge leg 24. In this manner the flat signal member 12 is pivotally mounted on the box 1 for movement between nonsignaling and signaling positions independently of movement of the door 2 between closed and open positions. The signaling position of the signal member 12 is shown in dot-dash lines in FIG. 4.

Thus, signal devices shown in FIGS. 1 and 4 function and operate in the same manner in accordance with the concepts of the invention.

Accordingly, the new signal device of the invention and its particular features and relationships provide a simple, reliable and inexpensive mail delivery-indicating signal actuated by a mailman to indicate mail delivery before opening the mailbox door to deposit mail in the mailbox, and thereby satisfies the stated objectives, overcomes problems that have been presented by prior art structures, and satisfies needs that have long existed in the art.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, devices, components, elements, arrangements, parts, combinations and relationships are set forth in the appended claims.

I claim:

1. A mail delivery-indicating signaling device for a mailbox of the type having a box provided with an open end, a flanged door for said open end having a pivot mounting at the bottom door edge on the mailbox for movement between open and closed positions with respect to said box open end, and latch means normally holding the door in closed position; in which the latch means includes an L-shaped bracket mounted on the door adjacent the top door edge projecting outward of the door releasably engageable with a bracket mounted on the box; in which said L-shaped bracket has a flat downturned flange spaced outward of and oriented parallel to said door adapted to be engaged by the mailman and pulled outwardly to open the door on said pivot mounting; in which the mailbox is provided with a mail pickup signal device; and in which the mailbox is provided with a mail delivery signaling device actuated or released for movement to signaling position upon movement of the door to open position; wherein the improvement comprises:

(a) a generally flat mail delivery-indicating signal member pivotally mounted on the mailbox for movement between signaling and nonsignaling positions independently of opening and closing movements of the mailbox door and having a contour similar to that of the mailbox door and also having a height less than that of said door and a width substantially the same as that of said door;

(b) a signal control strap pivotally mounted on the flat signal member adjacent the top edge of said signal member for rotational movement above and laterally of the flat signal member and releasably connected with said latch means flat downturned L-shaped bracket flange when said strap extends vertically upward from said flat signal member; and (c) said strap having actuating flange means adapted to be pressed by a mailman to rotate said strap to disconnect said strap from said flat downturned bracket flange to permit said signal member to rotate on its pivotal mounting independently of mailbox door movement to a mail delivery-indicating position below said door, before the door is opened by the mailman pulling said flat downturned bracket flange to deliver mail into said box;

(d) whereby said door may be opened and closed by the mailman without disconnecting said flat signal member to pick up mail in the box.

2. The construction defined in claim 1 in which the flat mail delivery-indicating signal member is pivotally mounted on the pivot mounting of the mailbox door for movement between signaling and nonsignaling position independently of opening and closing movement of the mailbox door.

3. The construction defined in claim 1 in which hinge members are crimp-mounted on the mailbox door adjacent the lower corners of said door; in which hinge brackets are formed at the lower corners of the signal member; and in which said hinge brackets are pivotally mounted on said crimp-mounted hinge members for movement of the signal member between signalling and nonsignaling positions independently of opening and closing movement of the mailbox door.

* * * * *

UNITED STATES PATENT AND TRADEMARK OFFICE

CERTIFICATE OF CORRECTION

PATENT NO. : 4,492,335

DATED : January 8, 1985

INVENTOR(S) : Bobby V. Davis

It is certified that error appears in the above-identified patent and that said Letters Patent is hereby corrected as shown below:

Col. 4, line 2, the word "now" should be - not - .

Signed and Sealed this

*Twenty-first* Day of *May 1985*

[SEAL]

*Attest:*

DONALD J. QUIGG

*Attesting Officer*

*Acting Commissioner of Patents and Trademarks*